US006796371B2

(12) United States Patent
Eppli et al.

(10) Patent No.: US 6,796,371 B2
(45) Date of Patent: Sep. 28, 2004

(54) ROLLER

(75) Inventors: Bernd Eppli, Königsbronn (DE); Markus Rieck, Nattheim (DE); Mario Wipprecht, Königsbronn (DE); Heinz-Michael Zaoralek, Königsbronn (DE)

(73) Assignee: Schwabische Huttenwerke GmbH, Aalen-Wasseralfingen (DE)

( * ) Notice: Subject to any disclaimer, the term of this patent is extended or adjusted under 35 U.S.C. 154(b) by 5 days.

(21) Appl. No.: 10/372,493

(22) Filed: Feb. 21, 2003

(65) Prior Publication Data

US 2003/0162640 A1 Aug. 28, 2003

(30) Foreign Application Priority Data

Feb. 22, 2002 (DE) ..... 102 07 505

(51) Int. Cl.[7] ..... F28F 5/02

(52) U.S. Cl. ..... 165/89; 165/186; 492/6; 492/46

(58) Field of Search ..... 165/89; 492/6, 492/46, 5

(56) References Cited

U.S. PATENT DOCUMENTS 1,563,216 A * 11/1925 Moog ..... 241/292
4,607,420 A * 8/1986 Vomhoff ..... 492/5
6,039,681 A * 3/2000 Heinz-Michael ..... 492/20
6,299,733 B1 * 10/2001 Graf et al. ..... 162/272
6,370,953 B1 * 4/2002 Ahokas et al. ..... 73/470
6,436,022 B1 * 8/2002 Zaoralek ..... 492/46
6,474,402 B1 * 11/2002 Sauer et al. ..... 164/428

FOREIGN PATENT DOCUMENTS

| | | |
|---|---|---|
| DE | 33 04 076 A1 | 8/1984 |
| DE | 40 36 121 A1 | 1/1992 |
| DE | 693 04 597 T2 | 3/1997 |
| DE | 198 13 718 A1 | 10/1999 |

* cited by examiner

*Primary Examiner*—Allen J. Flanigan
(74) *Attorney, Agent, or Firm*—RatnerPrestia

(57) ABSTRACT

A roller for thermally treating web-shaped media, comprising a roller body which is rotatable about its central longitudinal axis, and peripheral bores introduced in axial parallel in the roller body, for conveying a heating medium, wherein other axially parallel balancing bores are formed in the roller body in addition to the peripheral bores for the heating medium, said balancing bores running from an end face of the roller body towards the center of the roller body.

12 Claims, 2 Drawing Sheets

ROLLER

BACKGROUND OF THE INVENTION

1. Technical Field

The invention relates to a roller for thermally treating web-shaped media, comprising a roller body which is rotatable about its central longitudinal axis and peripheral bores introduced in axial parallel in the roller body, for conveying a liquid heating medium.

2. Description of the Related Art

Such a roller is known for example from DE 40 36 121 A1 and is to be described in the following by referring to FIG. 3 which shows a partial, longitudinal section through such a roller.

In FIG. 3, a heating and/or cooling roller for working material webs, such as for example paper, is indicated as a whole by the reference numeral 8. The roller 8 comprises a roller body 10, on whose two end faces flange trunnions 30*a*, 30*b* are mounted using attaching means 13, i.e. bolts or screws. In this way, the flange trunnion 30*a* serves both to bear the roller in a roller bearing (not shown) and to charge/discharge the roller 8 with/of liquid heating/cooling medium, which is firstly guided via a supply line 16 through the flange 30*a* into the interior of the roller 8 and is then directed via the line 16*a* and other connecting lines into axially parallel, peripheral bores 20. The peripheral bores 20 are connected to each other by lines in such a way that a series flow arrangement of peripheral bores is realized. Used heating/cooling liquid can be removed via an internal space 12 of the roller via a line 14*a*.

At the peripheral bore 20 in question, a line 19 is provided at the opposite end of the roller 8, said line 19 removing the used liquid from the roller 8 via other lines, via the thermally insulated line 14*a* and a discharge line 14. The flange trunnion 30*b* is usually connected to a drive for rotationally moving the roller 8.

If such rollers are relatively short, in combination with a large diameter, then they can be regarded as "rigid rotors" which can be balanced by mounting balancing weights in two planes, i.e. at the ends of the roller.

Unlike such "rigid rotors", long and slender rollers for treating web-shaped media at high speeds with respect to their dynamic running characteristics have to be regarded as "elastic rotors". In these elastic rotors, mounting balancing weights in two planes, i.e. at the ends of the roller, is no longer sufficient, i.e. satisfactory running characteristics are only achieved if the mass distribution can be specifically influenced in another plane near the center of the roller.

Various possibilities for such "tri-planar balancing" have already been made known. FIG. 1 of DE 33 04 076 A1, for instance, proposes a roller comprising a shrunk-in displacement body, in which balancing weights are mounted in the center of the roller, on said displacement body.

In the case of deflecting rollers made of thin steel lines, devices can be attached in the center of the central bore, and balancing weights in turn mounted on said devices.

However, all these measures make it necessary—once it has been established that a correction is required in the center of the roller, for example when checking a roller on a balancing machine—firstly to dismantle the roller and in particular to remove the screwed-on trunnions on the two ends of the roller body, so that the correction weights can be mounted in the roller.

In addition, FIG. 3 in DE 33 04 076 A1 proposes mounting containers in the interior of the roller which can be filled from outside with different quantities of liquid. This would then theoretically enable a correction in the third balancing plane without having to dismantle the roller. However, this theoretical possibility has never been put into practice.

SUMMARY OF THE INVENTION

The invention is based on the object of providing a roller for thermally treating web-shaped media of the type cited, in which the disadvantages mentioned above do not occur. In particular, it is the intention to propose a roller, whose mass distribution can be corrected at any time in a third balancing plane, in particular in the center of the roller, without the necessity of dismantling the roller trunnions.

This object is solved in accordance with the invention by a roller for thermally treating web-shaped media, comprising a roller body which is rotatable about its central longitudinal axis and peripheral bores in said roller body, introduced in axial parallel, for conveying a liquid heating medium, wherein other axially parallel balancing bores are formed in the roller body in addition to said peripheral bores for said heating medium, the balancing bores running from an end face of the roller body towards the center of the roller body.

Expedient embodiments are defined by the features of the sub-claims.

The advantages achieved by the invention are based on the fact that such a roller is provided, as early as during its manufacture, with at least three axially parallel balancing bores in the roller shell, which are expediently distributed uniformly over the circumference of the roller. These bores should reach as far as the vicinity of the center of the roller, but can easily also protrude beyond it, and begin at an end face of the roller body, thus being open outwards relative to the roller body.

The hollow spaces formed by these balancing bores alone change the weight distribution and can therefore have a balancing effect.

In many cases, however, these hollow spaces alone are not sufficient, such that in accordance with a preferred embodiment, balancing weights are then introduced into the center of the roller via these balancing bores. Using at least three compensating bores separated by ca. 120° from each other, central imbalances and/or central deviations can be corrected in any direction.

In principle, it is also possible to introduce more than three balancing bores to accommodate the compensating weights; this can facilitate the balancing itself, but is more expensive to manufacture.

In the case of rollers comprising flanged trunnions, such as are often used today, it is possible to form these bores as an extension of the core bores for the threaded holes for screw-attaching the trunnions. These attaching screws for the flange trunnion can then be removed during the balancing procedure, since the radial load of the roller is limited to the weight of the roller, and the remaining attaching screws are sufficient for this purpose.

If a central deviation of the roller on a balancing machine is then established, said central deviation can be influenced by introducing balancing weights as far as the center of the roller via the threaded holes and the axially parallel balancing bores and the result can be immediately checked.

If the roller has been correctly balanced, then the attaching screws can be re-inserted and tightened, and a balanced roller is again available.

Balancing in this way can for example be necessary when an already balanced roller body is additionally provided with a coating after it has been assembled, and it has not been possible to apply said coating uniformly. Once the coating is complete, the central deviation can then be established and subsequently corrected.

It is further possible to correct a roller, which has been balanced while hot in order to establish its heated running characteristics, by introducing balancing weights via the additional bores, without having to dismantle the roller.

BRIEF DESCRIPTION OF THE DRAWINGS

The invention will now be illustrated in more detail by way of an example embodiment and by referring to the enclosed, schematic drawings, which show.

DETAILED DESCRIPTION

Figure 1:
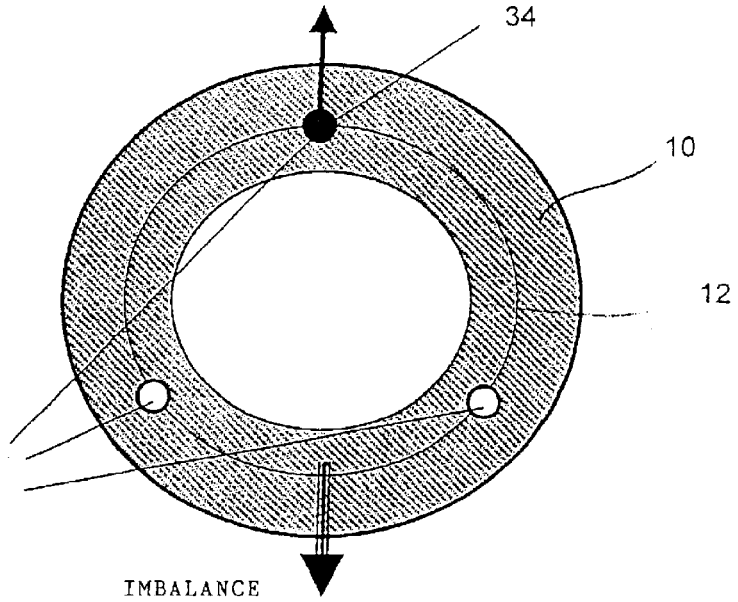
FIG. 1 a cross-section of a roller in accordance with the invention, comprising three balancing bores.

FIG. 1 shows a roller body 10 comprising a central roller bore 12. The axially parallel bores 20 for the liquid heating medium are not shown.

In the embodiment shown, three axially parallel balancing bores 32 are provided in the roller body 10, which are uniformly distributed over the circumference of the roller, i.e. each arranged at an angle of 120° with respect to each other.

Figure 2:
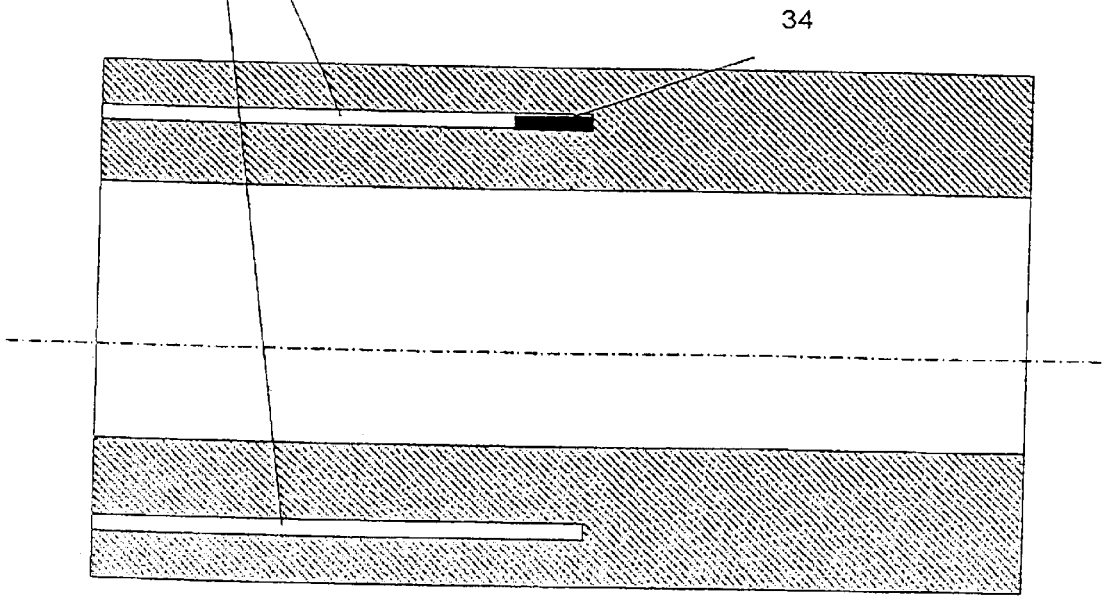
FIG. 2 a longitudinal section through the roller body of the roller according to FIG. 1.

As can be seen from FIG. 2, these balancing bores 32 reach up to about the vicinity of the center of the roller. In the upper balancing bore 32 in accordance with the representation in FIGS. 1 and 2, a compensating weight 34 is arranged which is situated about in the center of the roller body 10, as seen in its longitudinal direction.

Figure 3:
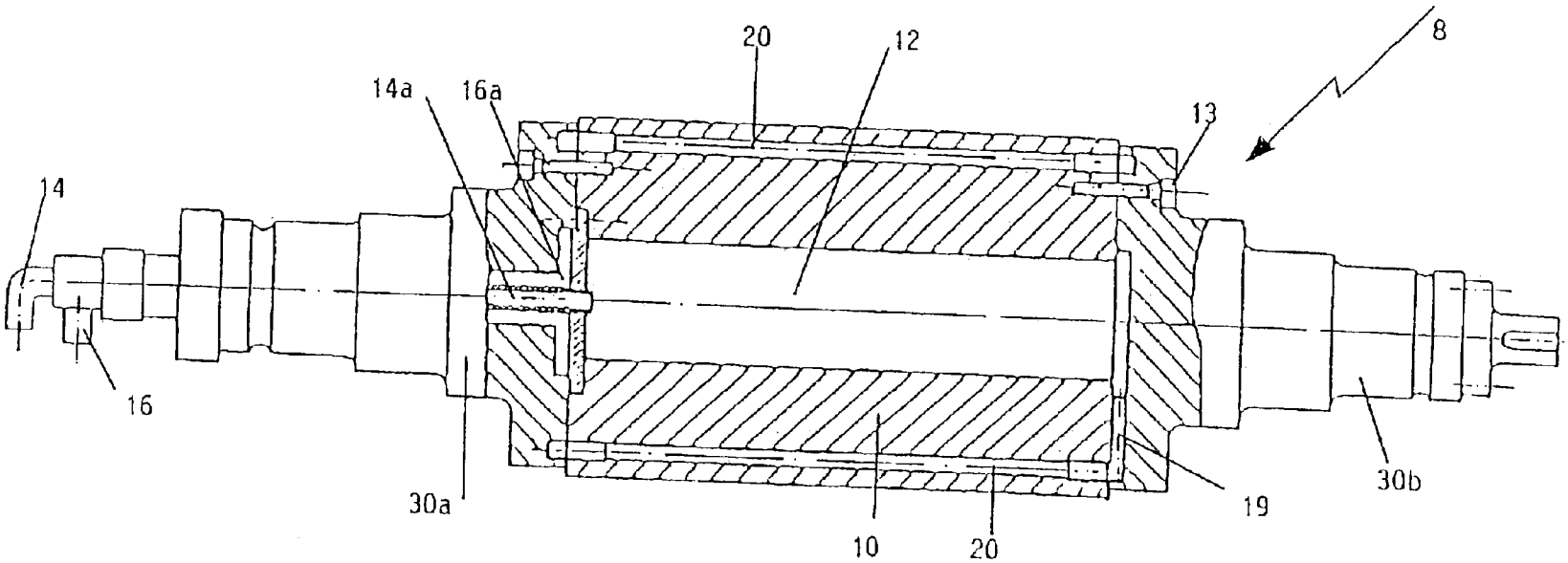
FIG. 3 a partial longitudinal section through the roller according to DE 40 36 121.

These balancing bores 32 are formed as an extension of three of the core bores for the threaded holes of the screws 13 for attaching the trunnions 30*a*, 30*b* to the roller body 10 (see FIG. 3), such that the roller body 10 can be held by the remaining screws 13 after these three screws 13 have been removed. If, for example, a central deviation is established in the roller on the balancing machine, said central deviation can be directly influenced by introducing the balancing weights 34 up to the center of the roller via the threaded bores in the trunnion 30*a*, 30*b* and the balancing bores 32 and the result can be immediately checked.

In addition to the balancing bores 32, other axially parallel balancing bores (not shown) can be introduced from the two ends of the roller into the roller body, said balancing bores not reaching as far as the center of the roller but rather to at least two different, additional balancing planes. Where necessary, and also in combination with compensating weights, this allows balancing to be further refined.

As an alternative to the embodiment shown, the balancing effect can also be achieved by empty hollow spaces, i.e. the empty balancing bores 32, which for example are subsequently introduced into the roller body via the threaded bores. Lastly, there is also the possibility of at least partially filling the balancing bores 32 with a liquid, in order to fine-tune balancing in this way.

In addition to the compensating weights 34, the usual compensating weights are mounted on this roller 8 at the two ends of the roller, e.g. on the flanges 30*a*, 30*b*.

In the foregoing description, preferred embodiments of the invention have been presented for the purpose of illustration and description. They are not intended to be exhaustive or to limit the invention to the precise form disclosed. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

What is claimed is:

1. A roller for thermally treating web-shaped media, comprising:

a) a roller body which is rotatable about its central longitudinal axis; and b) peripheral bores in said roller body, introduced in axial parallel, for conveying a liquid heating medium; wherein c) other axially parallel balancing bores are formed in the roller body in addition to said peripheral bores for said heating medium, the balancing bores running from an end face of the roller body towards the center of the roller body, said balancing bores extending only partially along the length of the roller body, said balancing bores not fluidly connected to said peripheral bores.

2. The roller as set forth in claim 1, wherein at least three axial balancing bores are provided.

3. The roller as set forth in claim 2, wherein said at least three axial balancing bores begin at one and the same end face of the roller body.

4. The roller as set forth in claim 1, wherein the balancing bores are uniformly distributed around the circumference of the roller body.

5. The roller as set forth in claim 4, wherein all the balancing bores have the same radial distance from the longitudinal axis of the roller body.

6. The roller as set forth in claim 1, wherein the balancing bores are filled with a liquid.

7. The roller as set forth in claim 1, wherein a compensating weight is mounted in at least one balancing bore, said compensating weight being situated in a balancing plane.

8. The roller as set forth in claim 7, wherein the balancing plane lies roughly in the center of the roller body.

9. The roller as set forth in claim 7, wherein alongside the balancing plane, two further balancing planes are provided at the ends of the roller, compensating weights being arranged in said further balancing planes.

10. The roller as set forth in claim 1, wherein additional balancing bores are introduced from the two-ends of the roller into the roller body, said balancing bores not reaching as far as the center of the roller but rather to at least two different, additional balancing planes.

11. The roller as set forth in claim 1, comprising at least one flange trunnion screwed onto an end of the roller body, wherein at least one balancing bore is formed as an extension of the core bores for the threaded holes for screw-attaching the trunnions.

12. The roller as set forth in claim 11, wherein all the balancing bores are formed as an extension of the core bores for the threaded holes for screw-attaching the trunnions.

* * * * *